United States Patent [19]

Gritsch

[11] 3,949,437

[45] Apr. 13, 1976

[54] HAIR-DO PROTECTING HEAD REST

[75] Inventor: Franz S. Gritsch, Staten Island, N.Y.

[73] Assignee: Lawrence Peska Associates, Inc., New York, N.Y. ; a part interest

[22] Filed: Mar. 18, 1974

[21] Appl. No.: 451,957

[52] U.S. Cl. ..... 5/338
[51] Int. Cl.[2] ..... A47G 9/00
[58] Field of Search ..... 5/338, 337, 327 B

[56] References Cited

UNITED STATES PATENTS

| | | | |
|---|---|---|---|
| 3,312,987 | 4/1967 | Emery | 5/337 |
| 3,626,526 | 12/1971 | Veil | 5/338 |
| 3,648,308 | 3/1972 | Greenawalt | 5/338 |

*Primary Examiner*—Robert L. Wolfe
*Assistant Examiner*—Doris L. Troutman

[57] ABSTRACT

A head rest device for protecting the hair arrangement from becoming disturbed when the user lies down to take a nap or to sleep. It includes a base board of substantial width and depth to replace the usual pillow, and has a head support extending upwardly from an intermediate portion of the base board and secured thereto, the head support having left and right upwardly sloping shoulder portions intersecting at their tops with the upper edges of the downwardly curved catenary-like head engaging portion. The head support is preferably made of soft resilient molded material with rounded edges for comfort.

1 Claim, 4 Drawing Figures

HAIR-DO PROTECTING HEAD REST

This invention relates to improvements in devices in the nature of a head rest and the like for protecting the hair-do of the user from being disturbed or mussed up.

An object of the invention is to provide a novel and improved head rest device for use principally by women and girls, so that when they are reclining in bed, their hair-do and hair-set would not be disturbed or disarranged.

Another object of the invention is to provide a novel and improved head rest device for use by persons who have recently been to the hairdresser to have their hair styled, dressed and arranged in a hair-do, and who might want to lie down and take a nap, or go to sleep at night, without having their hair-do undone by direct contact of their head with the usual bed pillows.

A further object of the invention is to provide a novel and improved head-rest and the like in which there is a main plane board portion upon which the user reclines, with an upraised head supporting portion carried by the main board portion, on which the user rests her neck and such portion of her head as will not disturb her hair-do.

Still another object of the invention is to provide a novel and improved head-rest and the like, which is usable also by men who have just had their longer presently styled hair arranged by the barber or hair stylist, so as to prevent disarrangement while reclining or sleeping.

Still a further object of the invention is to provide a novel and improved head-rest and the like, which is also usable by women to avoid disarranging wigs while reclining.

Another object of the invention is to provide a novel and improved head-rest and the like, which is formed of very few parts, and which can be made either by hand operations or by mass production, at low cost.

The above and other objects of the invention will become apparent from the following description of a preferred embodiment, thereof, as illustrated in the accompanying drawings, forming a part hereof.

Figure 1:
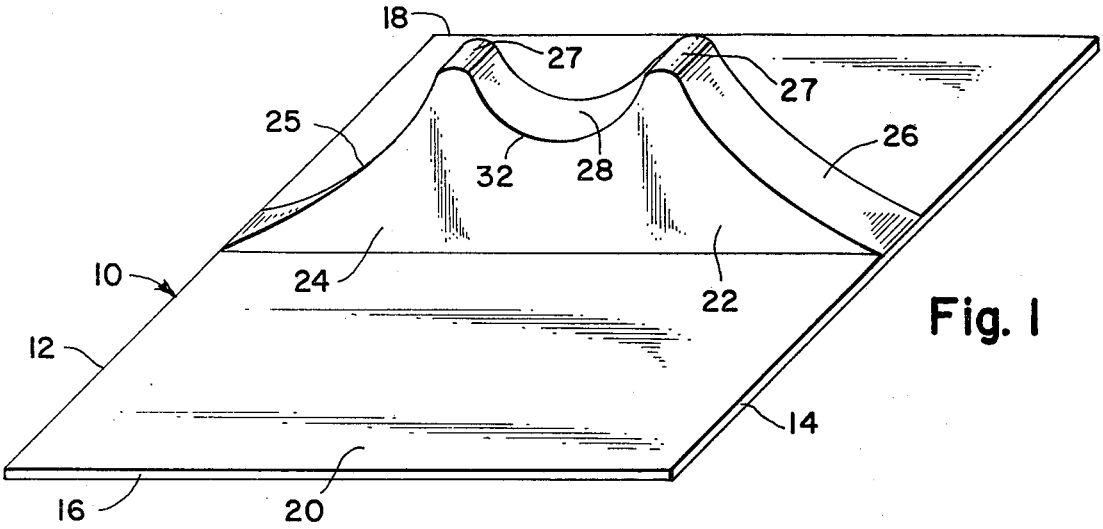
FIG. 1 is a perspective view of the head rest device.
Figure 2:
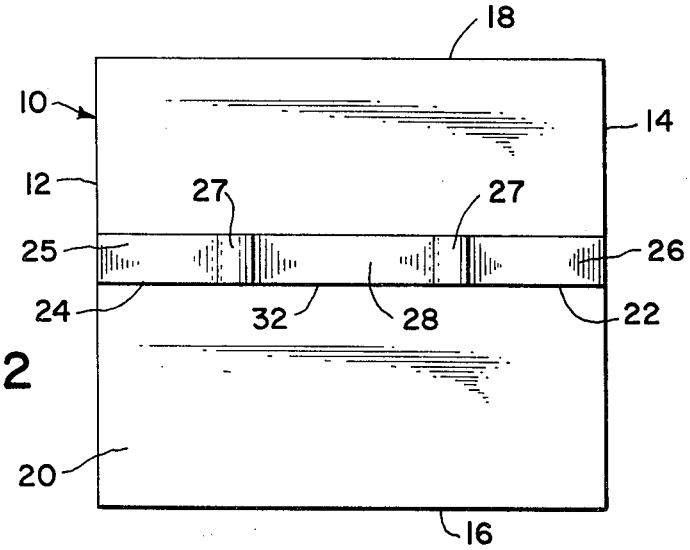
FIG. 2 is a top plan view of the head rest device of FIG. 1.
Figure 3:
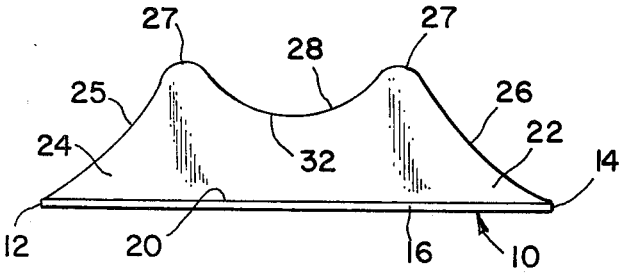
FIG. 3 is a front elevational view of the head rest shown in FIGS. 1 and 2.

In connection with modern hair styling, it has been a problem for women and girls to have their hair arranged by a hairdresser, only to find that when they take a nap or go to bed, their hair-do becomes undone or disarranged, so that after the nap, or the next day, it is difficult and disappointing to try to rearrange the hair setting for a pleasant and attractive appearance.

Further, this is also a problem when a wig is worn, for the setting of the wig may come askew, and most women have little experience in rearranging the wig setting. In addition, when a woman puts her hair up in curlers before retiring, it is frequently uncomfortable to sleep with the curlers in her hair, and yet this must be done if her hair is to look well the next day or that evening on going out. With the new look for men, what is to say, with longer hair, they have similar problems, and may go to an expensive hair stylist and find that on awaking the next day their styling is disarranged.

The present invention is intended to provide a simple solution to this problem. In order to understand clearly the nature of this invention and the best means for carrying it out, reference may be had to the drawings, in which like numerals denote similar parts throughout the several views.

As shown, there is a main body portion in the form of a board 10 formed of wood, plastics, or plywood, or even composition material of light weight and minimal thickness. The board 10 has left and right side edges 12 and 14 intersecting with front and rear edges 16 and 18 to form a top surface 20 upon which the user reclines. For supporting the user's head and neck, there is a head support member 22 with its lower wall portion 24 secured to an intermediate portion of the main board 10 by any suitable means, such as nails, screws, or adhesives, and it has its left and right shoulder portions 24 and 26 sloping gradually upwardly to roundedly meet at their summits 27, with the upper ends of the downwardly curved head rest portion 28.

Figure 4:
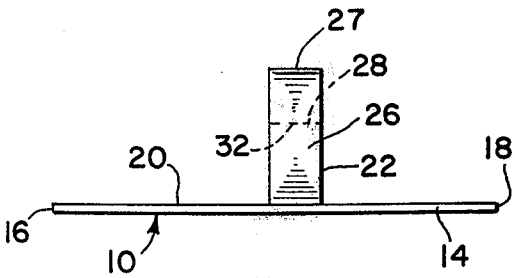
FIG. 4 is a right side elevational view of the head rest device shown in FIG. 2.

In use, the entire board and head rest portions is placed on the bed or couch in place of the usual pillow so that the portion 28 supports the head. For further comfort, the entire device may be covered with soft molded plastics or quilted cloth. The head rest 22 may also be molded from such lightweight plastic material, and rounded at any edges thereof. As an example of one form of the device, the board 10 may be about 18 inches wide and about 16 inches from front to back edges, and the head support may be about one and one-half inches in thickness, as seen in FIG. 4, and about an elevation of two and one-half inches from the base edge 24 to the lowest portion 32 of the head support.

It is thus seen that this device is quite comfortable, and aids in avoiding disarrangement of a hair-do or wig, and also makes wearing hair curlers more comfortable.

Although a preferred embodiment of the invention has been set forth in specific terms, it is understood that various changes may be made in size, shape, materials and arrangement without departing from the spirit and scope of the invention as claimed.

Having herein described the invention, what is claimed as new is:

1. A head rest and support device comprising a main body board portion means with front and rear edges intersecting with left and right edges to form a wide and broad main upper surface upon which the user reclines, head support means on and molded integrally with said board portion means, and downwardly curved head engaging portion means on and molded integrally with said head support means for resting of the user's head thereon, said head support means comprising left and right shoulder portions carried by and molded integrally with said main upper board portion means, said shoulder portions sloping gradually inwardly upwardly from said left and right edges of said board portion means to connect at their upper ends with the upper edges of said downwardly curved head engaging portion means, so that the lowermost portion of said head engaging means is elevated somewhat above the main board portion upper surface, said head support means and said main body portion board means being formed of similar lightweight substantially thick materials and molded integrally with each other by molding them together as a single unit for furnishing the desired head and neck support.

* * * * *